US009059495B2

(12) United States Patent
Ruiz-Cruz et al.

(10) Patent No.: US 9,059,495 B2
(45) Date of Patent: Jun. 16, 2015

(54) COMPACT MULTIPORT WAVEGUIDE SWITCHES

(76) Inventors: Jorge A. Ruiz-Cruz, Madrid (ES); Mohamed M. Fahmi, Waterloo (CA); Raafat R. Mansour, Waterloo (CA)

( * ) Notice: Subject to any disclaimer, the term of this patent is extended or adjusted under 35 U.S.C. 154(b) by 403 days.

(21) Appl. No.: 13/489,289

(22) Filed: Jun. 5, 2012

(65) Prior Publication Data

US 2013/0321096 A1 Dec. 5, 2013

(51) Int. Cl.
*H01P 1/12* (2006.01)
*H01P 5/12* (2006.01)
*H01P 1/10* (2006.01)

(52) U.S. Cl.
CPC . *H01P 1/122* (2013.01); *H01P 5/12* (2013.01)

(58) Field of Classification Search
CPC ..... H01P 1/10
USPC ..... 333/106, 108, 113, 122, 135, 137, 157, 333/258
See application file for complete search history.

(56) References Cited

U.S. PATENT DOCUMENTS

| | | | | |
|---|---|---|---|---|
| 4,652,840 | A * | 3/1987 | Kosugi | 333/105 |
| 4,806,887 | A * | 2/1989 | Au-Yeung | 333/106 |
| 7,193,488 | B2 * | 3/2007 | Mayer | 333/106 |
| 7,292,125 | B2 * | 11/2007 | Mansour et al. | 333/258 |
| 8,248,178 | B2 * | 8/2012 | Lange | 333/21 A |

* cited by examiner

*Primary Examiner* — Dean Takaoka
(74) *Attorney, Agent, or Firm* — Nasser Ashgriz; UIPatent Inc.

(57) ABSTRACT

A waveguide switch based on alternating short and open loads in a waveguide path. In one embodiment, the switch being made up of four waveguides connected by sections of ridge waveguides where simple short-circuit loads can be activated to control the signal paths. The switch being adapted for the C-, R- and T-type switches. Another embodiment of the same device being adapted for SPT type switched.

18 Claims, 9 Drawing Sheets

COMPACT MULTIPORT WAVEGUIDE SWITCHES

FIELD OF THE INVENTION

The present invention is related to microwave switches and more particularly to the realization of miniature multiport waveguide switches for high power applications.

BACKGROUND OF THE INVENTION

Waveguide switches are used in a broad range of applications with two main functions: They are used either to route signals for connecting the appropriate network elements or to provide redundancy schemes. Many spacecraft systems incorporate sophisticated switch matrices in order to increase the system reliability. They provide redundancy connections which are activated to bypass failing devices either automatically or by ground terminal commands.

The switching networks are relatively easy to realize at low frequencies and at low signal power levels. The switches for low power applications are typically implemented using coaxial technology. Waveguide switches, on the other hand, are preferred in high frequency and for high power applications. However, when several ports are involved, signal routing in waveguide switches (such as changes in the propagation direction or signal crossovers) are more difficult to implement limiting the use of conventional waveguide switches to C and R switches. At the same time, since mass and volume must be kept to a minimum in many applications such as satellite systems, there are demands for new improved compact switch designs with more advanced functionality.

Several waveguide switches have been proposed for RF and microwave systems. Many of them are based on the rotation of a junction or waveguide section inside the main body of the device. They are either manually operated or controlled by electromechanical systems. In this last case, they have an internal mechanical linkage with a motor or a rotary solenoid for automated actuation (e.g., U.S. Pat. No. 4,967,170).

Ridge waveguides were combined with MEMS switches for the realization of simple switch configurations such as SPST, SP2T and C-switches [U.S. Pat. No. 7,292,125]. The structures proposed in prior art, such as those in U.S. Pat. Nos. 4,967,170 and 7,292,125, cannot be easily employed in the realization of waveguide T-switches or switches with relatively large number of ports such as SP4T or SP6T switches. The availability of such waveguide switches makes it possible to realize highly advanced compact switch matrices with fewer elements.

SUMMARY OF THE INVENTION

The present invention provides a novel mechanism to implement waveguide switches. Instead of using rotating junctions, the switch is based on alternating short and open circuits in the propagation direction of the ridge waveguides. The shorts can be provided with a variety of very simple elements. Four-port C and R-type and, most importantly, T-type switches are provided using the same short circuit load concept. All the types are addressed with a very compact layout. These switches have the advantage of having simplicity of the operation. The structure does not require mechanical rotation of the junctions and maintains a very compact layout. All the port interconnections required for the T-switch are addressed.

In another embodiment of the same invention, a new ridge waveguide junction is proposed that allows the interface of waveguide port to several waveguide ports over a relatively large bandwidth. The junction makes possible to realize highly compact SPNT waveguide switches, such as SP4T and SP6T switches.

BRIEF DESCRIPTION OF THE DRAWINGS

In the figures, which illustrate, by way of example only, embodiments of the present invention.

DETAILED DESCRIPTION OF THE DRAWINGS

Figure 1:
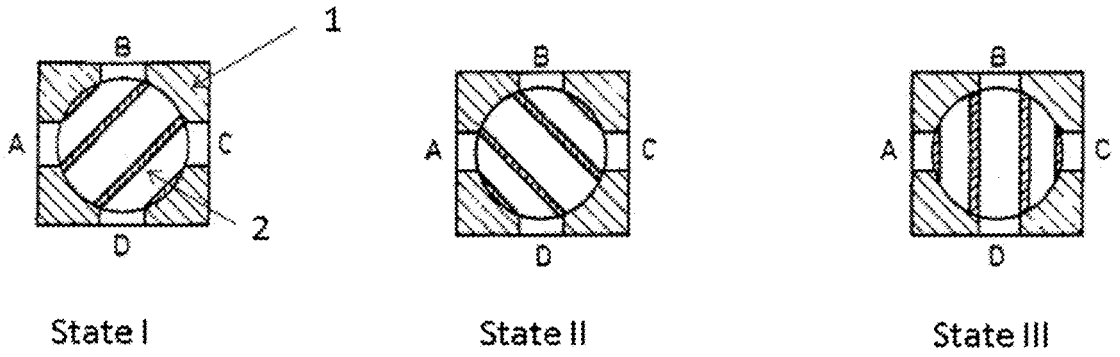
Figure 1 (prior art)
FIG. 1 shows a typical waveguide rotary R-switch (prior art)

FIG. 1 shows a waveguide rotary switch (prior art). The body of switch 1 has four waveguide ports denoted by A, B, C and D. The switch uses a rotary mechanism 2 that rotates around its axis to create waveguide paths between the ports to establish the three states of the R-switch. For example, in state I, the rotary mechanism is turned such that to establish transmission between port A and port B and simultaneously establish transmission between port C and port D.

Figure 2:
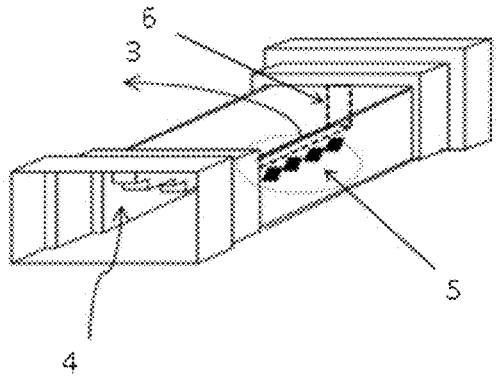
Figure 2 (prior art)
FIG. 2 shows a schematic waveguide switch implementing a ridge waveguide (prior art)

FIG. 2 shows a waveguide Single-Pole Single Through (SPST) switch (prior art) consisting of a ridge waveguide and two waveguide to ridge waveguide transformers. A set of short circuit loads 5 are used to connect the ridge 3 to the housing 6.

Figure 3:
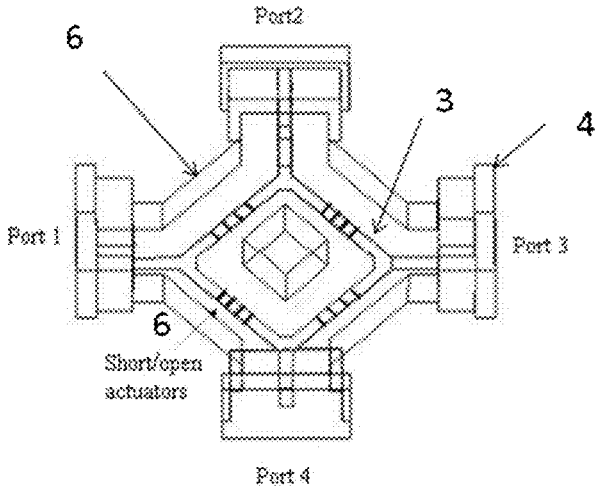
Figure 3 (prior art)
FIG. 3 shows a ridge waveguide C-switch (prior art)

FIG. 3 shows a waveguide C-switch (prior art) comprising of four waveguide ports, sections of ridge waveguides 3 and four waveguide to ridge-waveguide transformers. Four sets of short circuits loads that can be actuated to provide a short circuit between the ridge and the switch housing 6. The switch has two states. In state I, there is a transmission of microwave signal between port 1 and port 2 and port 3 and port 4, while in state II, there is a transmission between port 1 and port 4 and transmission between port 2 and port 3.

Figure 4A:
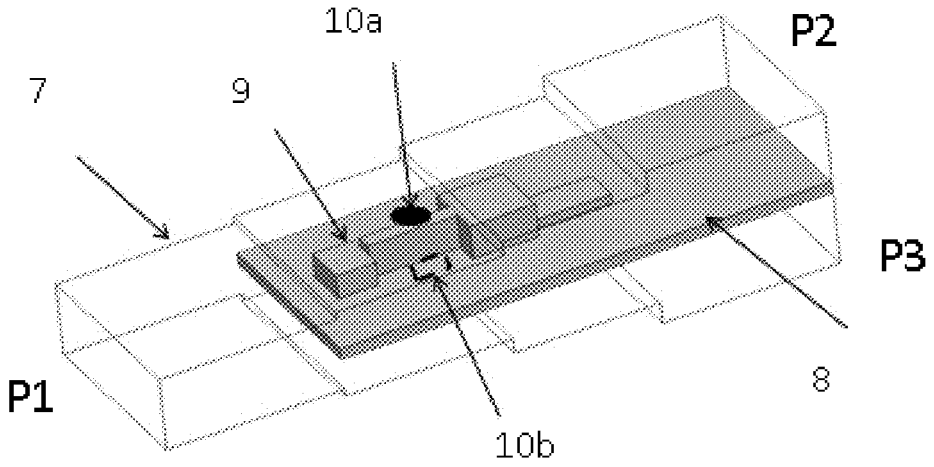
FIG. 4 is a 3-dimensional view and a side view of a SP2T switch to illustrate the operation of the present invention.
Figure 4B:
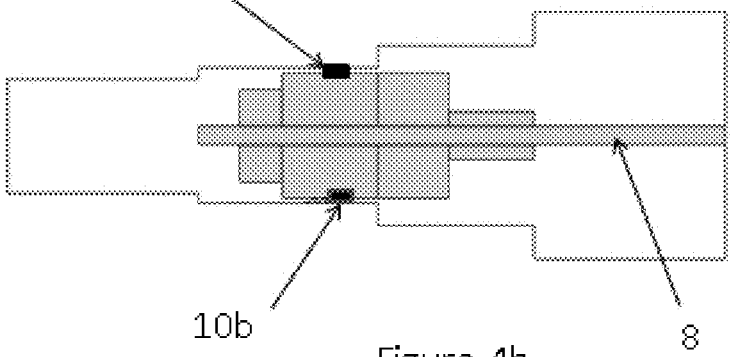

FIG. 4 shows a 3-dimensional view (FIG. 4*a*) and a side view (FIG. 4*b*) of waveguide switch for explaining the operation of the present invention. The structure has three ports P1, P2 and P3. An E-plane bifurcation of the rectangular waveguide enclosure 7 is achieved by a metal septum 8 having ridges on the top and bottom side of the septum. Short circuit loads 10*a* and 10*b* are marked by black dot in FIG. 4.

One short circuit load 10*a* is located on the top side of the metallic septum and another one 10*b* is located on the bottom side of the metallic septum. The ridge waveguide dimensions are optimized such that the microwave signal is directed from port P1 to port P3 while port P2 is kept isolated when the short circuit load 10*a* is used. When the short circuit load 10*b* is used the microwave signal is directed from P1-P2, while P3 is isolated. To illustrate the concept the short circuit loads are provided by screws attached to the waveguide enclosure that can be turned in to connect the ridges to the enclosure 7. Other elements could provide this short circuit load, the screw is the simplest solution to illustrate the concept.

Figure 5A:
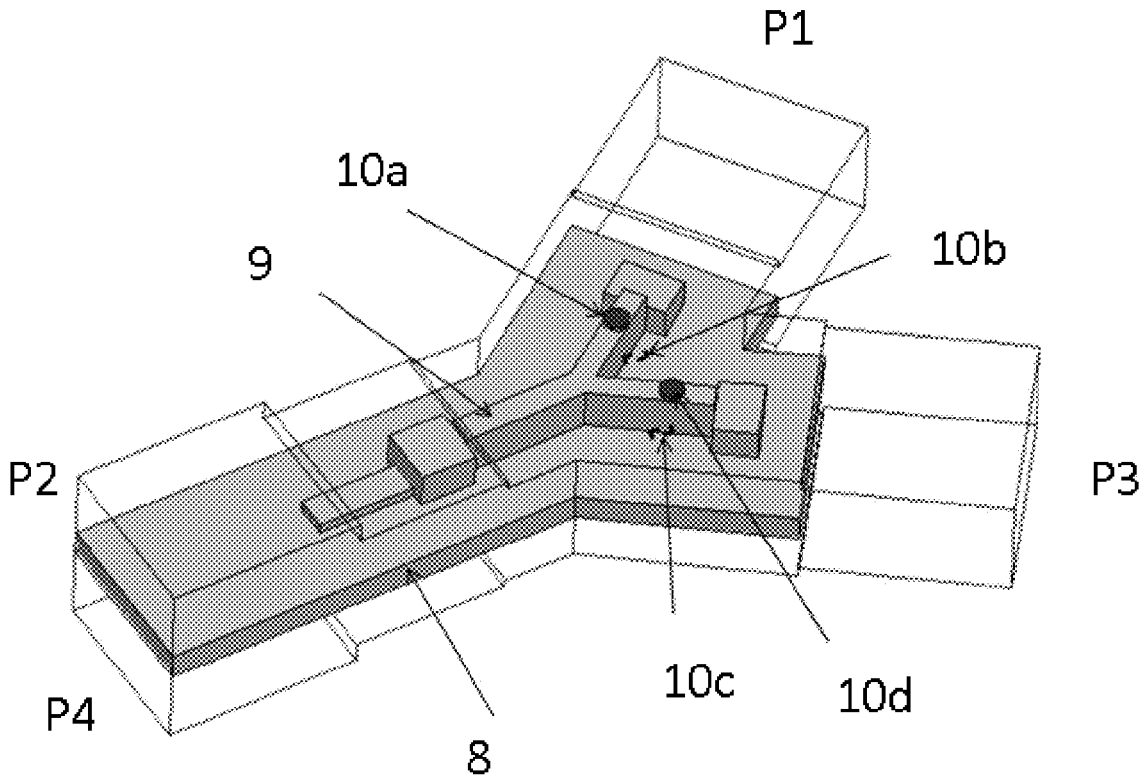
FIG. 5 is a view of a waveguide 4-port switch according to the first preferred embodiment of the present invention, which can be configured as C-switch.
Figure 5B:
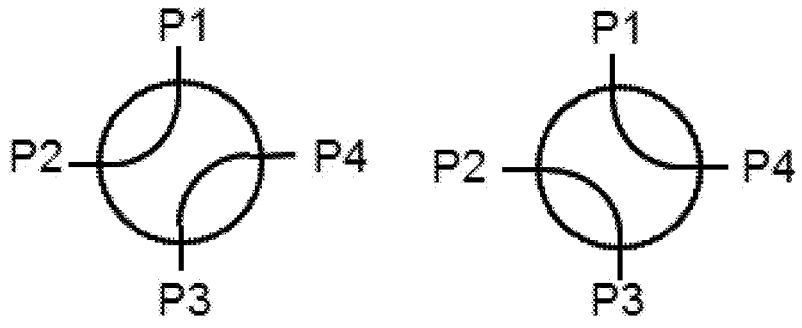

FIG. 5*a* shows one embodiment of the present invention. It is a C-type switch with two states (FIG. 5*b*). In state I, connections are established between P1-P2 and P3-P4, while in state II the connections are between P1-P4 and P2-P3. The whole C-switch structure is symmetric with respect to the septum 8 which has ridges 9 on the top and bottom of its surface. The two states are activated by four short circuit loads 10*a*, 10*b*, 10*c* and 10*d*. There are two short circuit elements per top/bottom layer of the septum. Only two shorts are activated at the same time to realize one state. In state I the short circuit loads 10*d* and 10*b* are used to provide connections between P1-P2 and P3-P4. While in state II, the short circuit connections 10*a* and 10*c* are used to provide connection between P1-P4 and P2-P3.

Figure 6A:
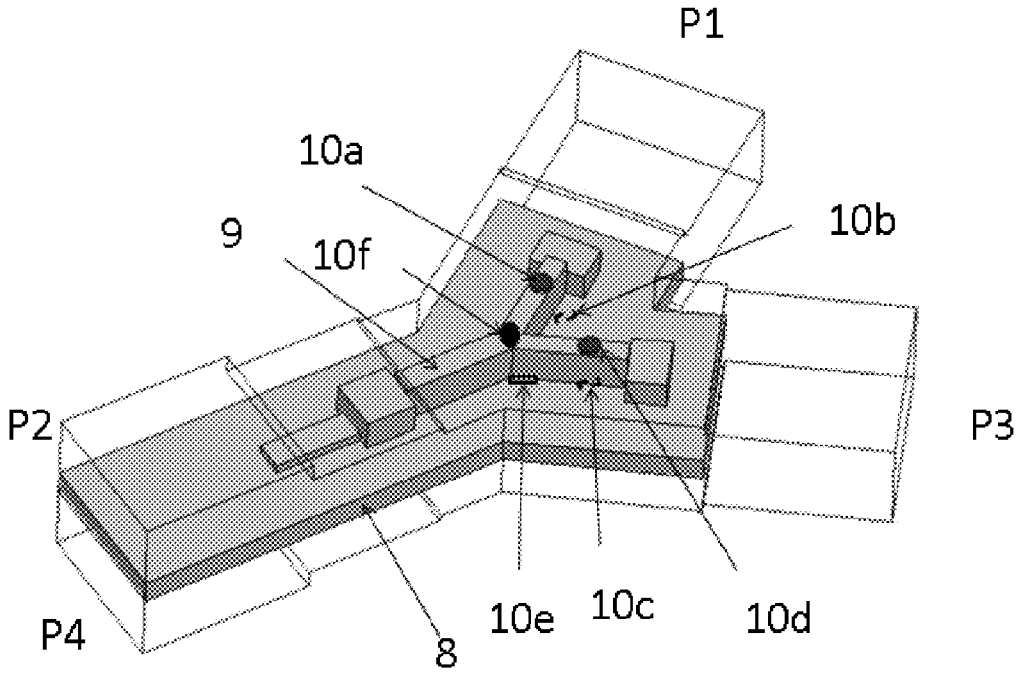
FIG. 6 is a view of a waveguide 4-port switch according to the first preferred embodiment of the present invention, which can be configured as R-switch.
Figure 6B:
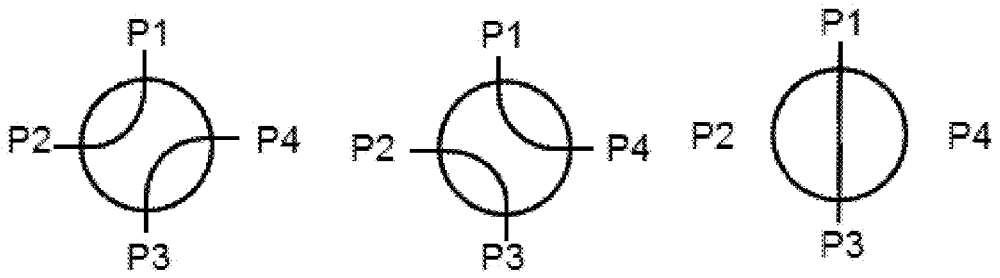

FIG. 6*a* shows a configuration similar to that shown in FIG. 5*a* to realize an R-switch. The R-switch has three states as illustrated in FIG. 6*b*. In state I, connections are established between P1-P2 and P3-P4, while in state II the connections are between P1-P4 and P2-P3. In state III connection are provided only between P1-P3. The three states are activated by six short circuit loads 10*a*, 10*b*, 10*c*, 10*d*, 10*e* and 10*f*. There are three short circuit elements per top/bottom layer of the septum. Only two shorts are activated at the same time to realize one state. In state I the short circuit loads 10*d* and 10*b* are used to provide connections between P1-P2 and P3-P4. While in state II, the short circuit connections 10*a* and 10*c* are used to provide connection between P1-P4 and P2-P3. In state III, the short circuit loads 10*e* and 10*f* are used to provide connection between P1-P3.

Figure 7A:
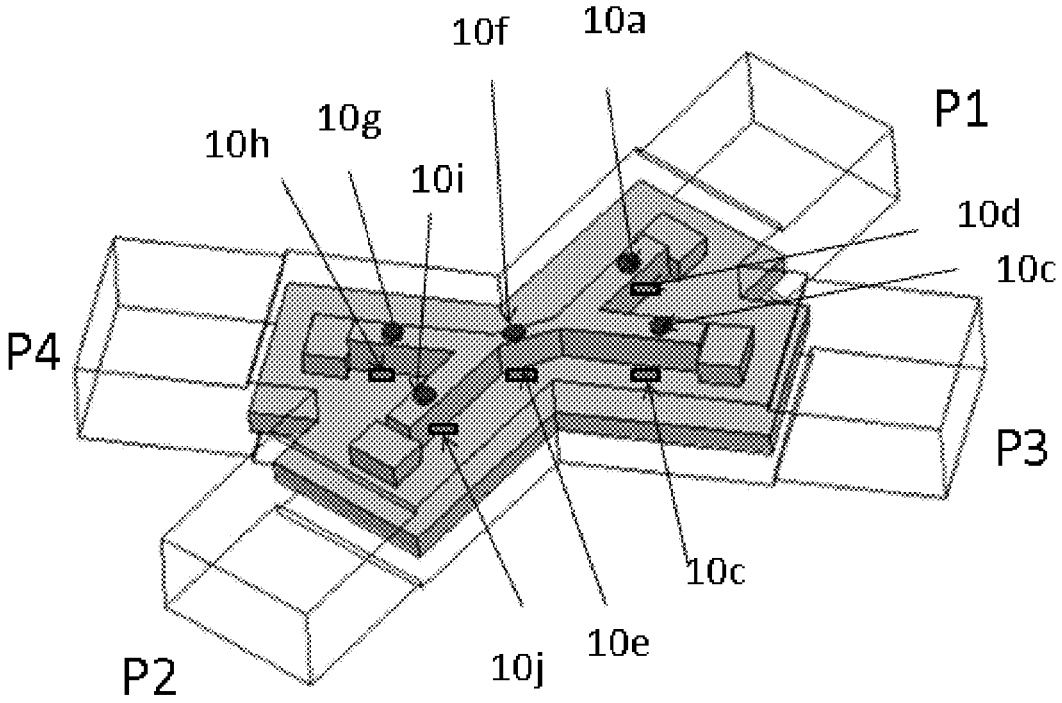
FIG. 7 is a view of a waveguide T-switch according to the first preferred embodiment of the present invention.
Figure 7B:
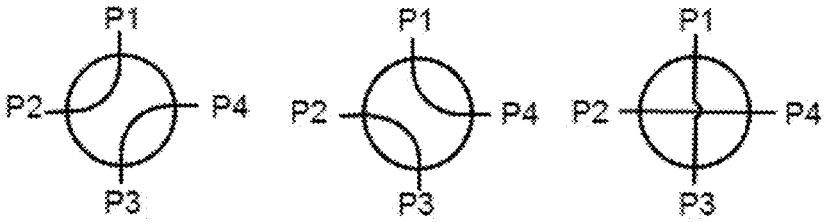

FIG. 7*a* shows a 3-dimensional view of a T-waveguide switch. The switch has 4 ports P1, P2, P3 and P4 and operating in three states as shown in FIG. 7*b*. In state I, connections are established between P1-P2 and P3-P4, while in state II the connections are between P1-P4 and P2-P3. In state III connection are provided between P1-P3 and P2-P4. The whole T-switch waveguide enclosure 7 is symmetric with respect to the septum 8, which has ridges 9 on top and bottom of its surfaces. The three states are controlled by 10 short circuit loads 10*a*, 10*b*, 10*c*, 10*d*, 10*e*, 10*f*, 10*g*, 10*h*, 10*i* and 10*j*. There are five short circuit elements per top/bottom layer of the septum. 4 shorts are activated at the same time to realize states I and II, 6 shorts are activated to realize state III. In state I the short circuit loads 10*b*, 10*j*, 10*d* and 10*g* are used to provide connections between P1-P2 and P3-P4. While in state II, the short circuit connections 10*a*, 10*i*, 10*c* and 10*h* are used to provide connection between P1-P4 and P2-P3. In state III the short circuit loads 10*e* and 10*f*, with 10*a*, 10*d* 10*h*, 10*j*, are used to provide connection between P1-P3 and P2-P4.

Figure 8:
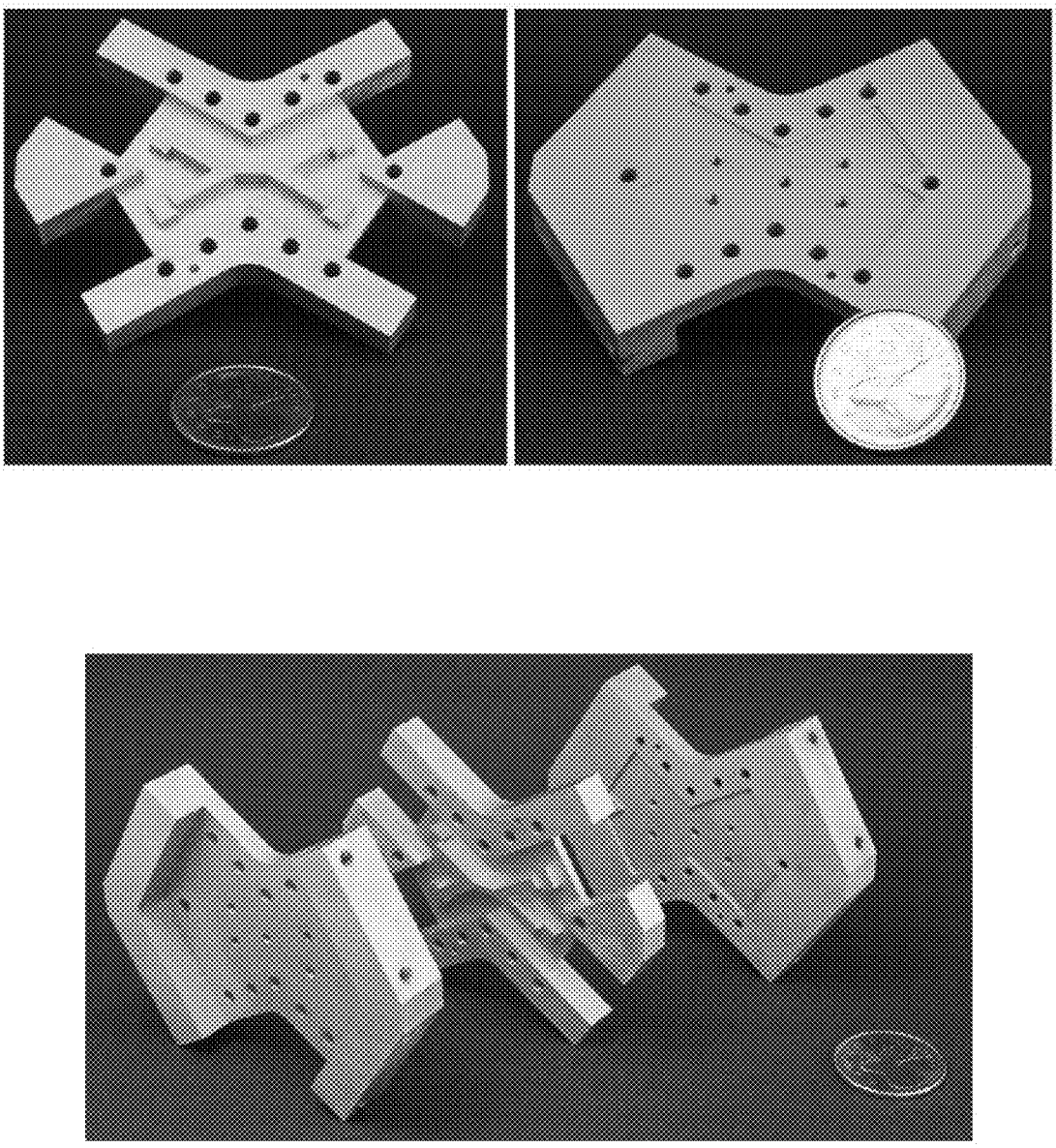
FIG. 8 shows pictures of a waveguide T-switch hardware fabricated based on FIG. 7.

FIG. 8 shows a T-waveguide switch fabricated according to FIG. 7. The switch consists of identical top lid and bottom lid. The septum 8 with the ridges 9 is fabricated with corners, along with the top and bottom lid to form the waveguide housing 7. The three sections are bolted together to form the T-switch. Five screws holes are made on each lid to introduce the short circuit loads. The T-Switch has been tested demonstrating excellent results.

Figure 9A:
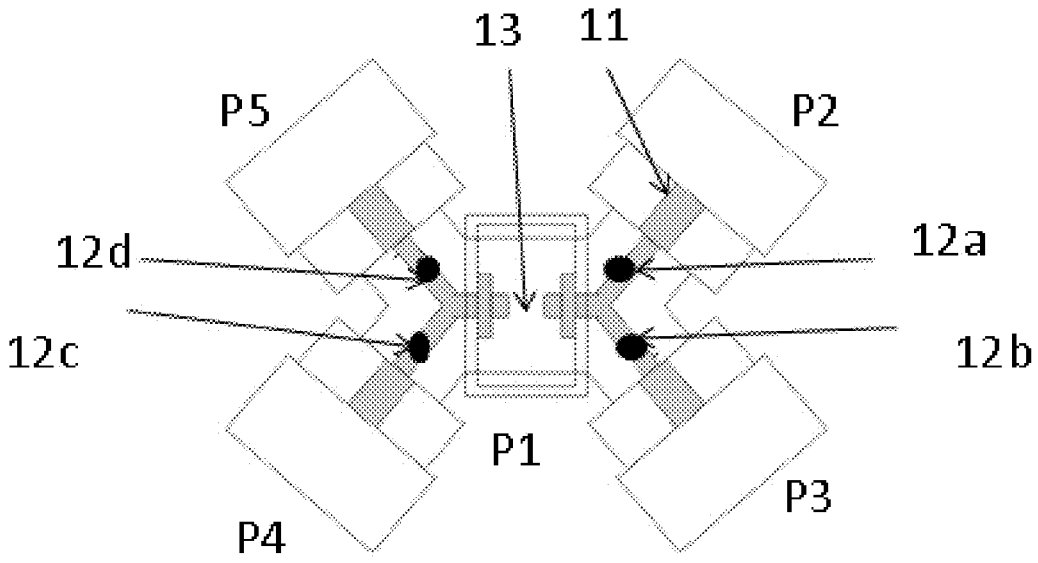
FIG. 9 shows a waveguide SP4T waveguide switch according to the second preferred embodiment of the present invention.
Figure 9B:
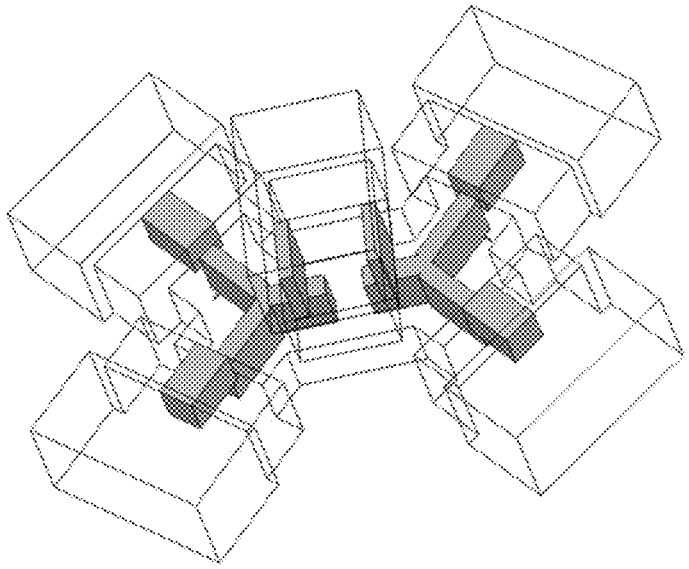

FIG. 9 shows an embodiment of a Single-Pole Four Through (SP4T) switch. FIG. 9*a* shows the top view while FIG. 9*b* illustrates a 3-dimensional view of the switch. It consists of an input port P1 and four output ports P2, P3, P4 and P5. The ports are interfaced to ridge waveguides 11. The ridges are attached to the switch enclosure 7. Four short circuit elements 12*a*, 12*b*, 12*c* and 12*d* are located in the gaps between the ridges and the enclosure to provide a short circuit between the enclosure and the ridges. The transmission between the input port P1 to the four ports is enabled by the 1-to-4 ridge waveguide junction 13. Three short circuit elements are used at the same time to realize the switch states. The short circuit elements 12*b*, 12*c* and 12*d* are used to provide transmission between P1-P2, while the short-circuit elements 12*a*, 12*c* and 12*d* are used to provide transmission between P1-P3.

Figure 10A:
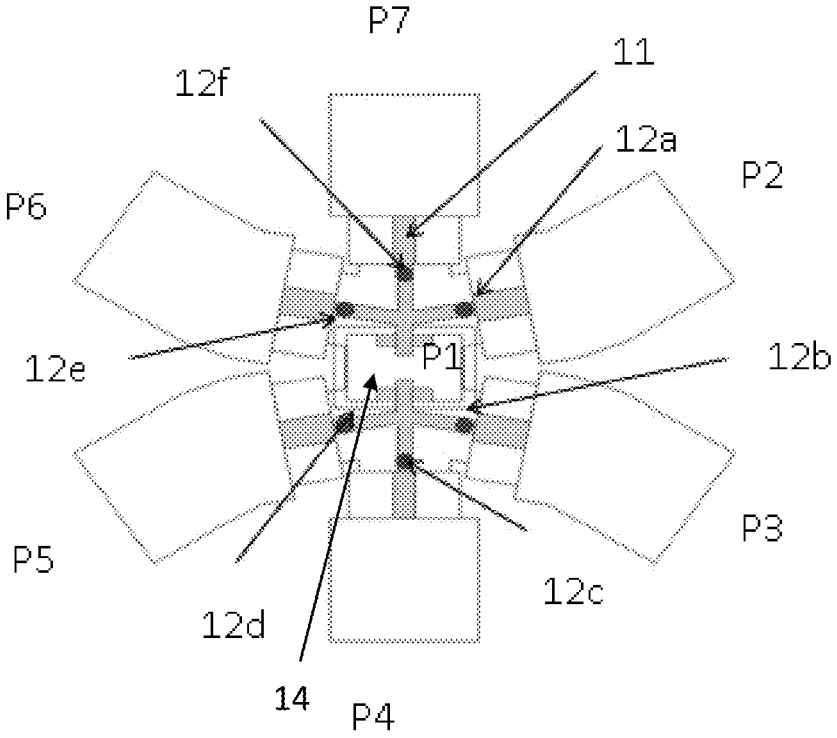
FIG. 10 shows a waveguide SP6T waveguide switch according to the second preferred embodiment of the present invention.
Figure 10B:
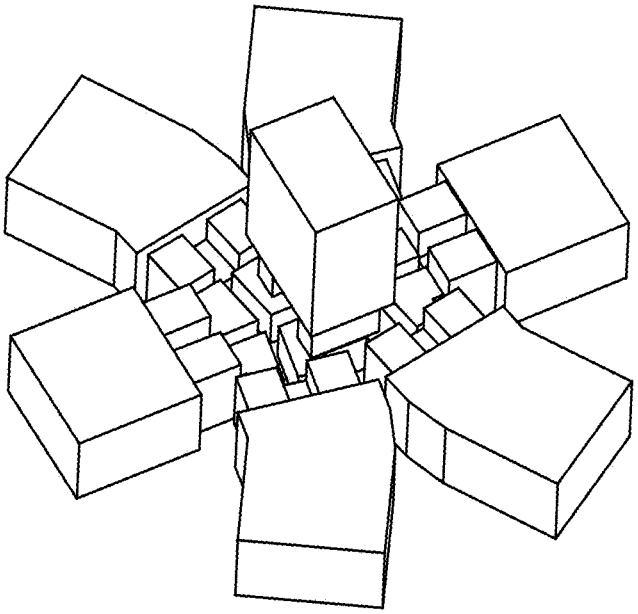

FIG. 10 shows an SP6T waveguide switch. It consists of an input port P1 and six output ports: P2, P3, P4, P5, P6 and P7. The ports are interfaced to ridge waveguides, where the ridges are attached to the switch enclosure 7. Six short circuit elements 12*a*, 12*b*, 12*c*, 12*d*, 12*e*, and 12*f* are located in the gaps between the ridges and the enclosure to provide a short circuit between the enclosure and the ridges. The transmission between the input port P1 to the six ports is enabled by the ridge waveguide junction 14. Five short circuit elements are used at the same time to realize the switch states. The short circuit elements 12*b*, 12*c*, 12*d*, 12*e* and 12*f* are used to provide transmission between P1-P2.

Figure 11:
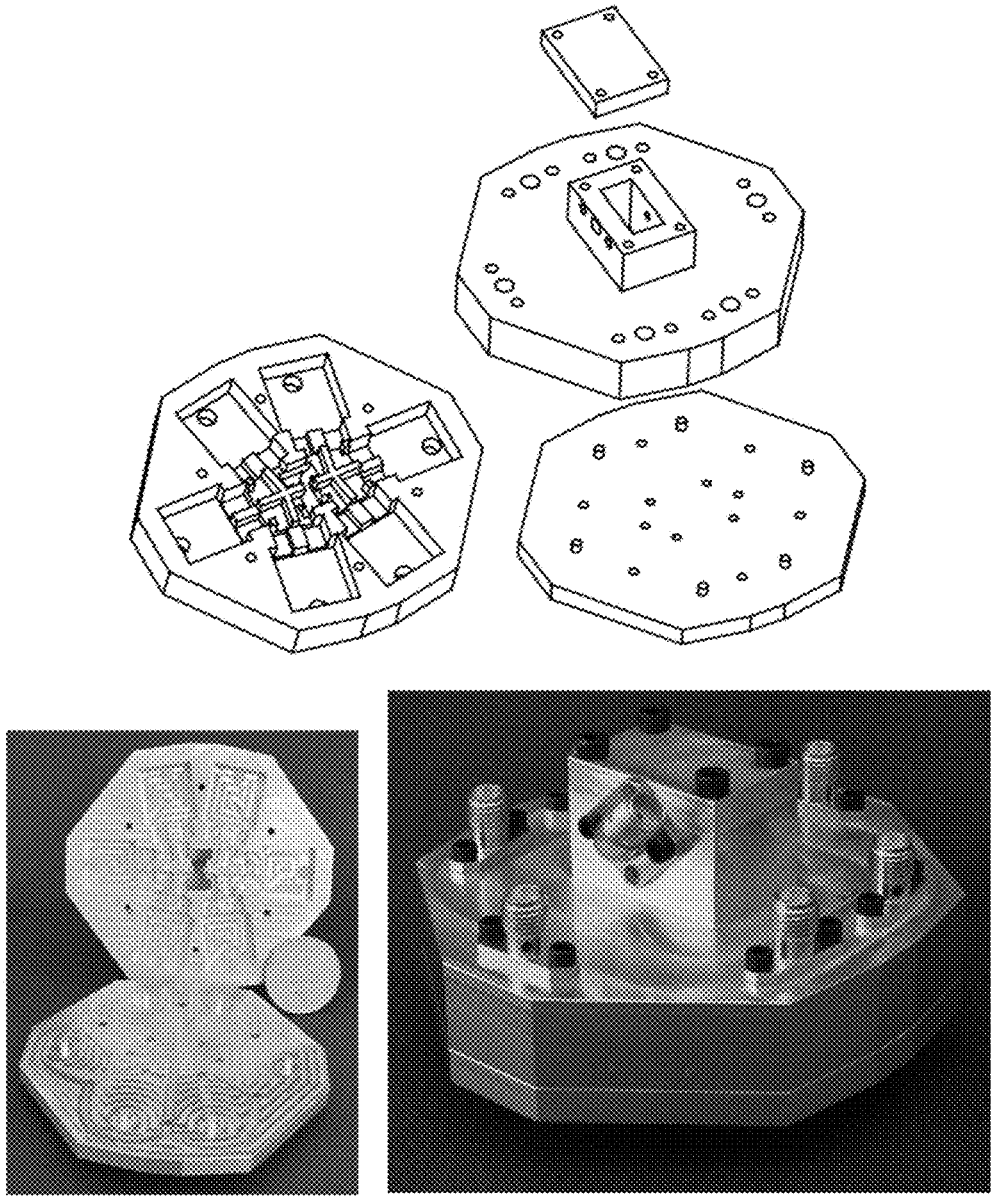
FIG. 11 shows a picture of fabricated waveguide SP6T.

FIG. 11 shows an SP6T waveguide switch fabricated according to FIG. 10. The switch consists of two lids. The top lid has the input port P1 and the ridge waveguides 11. The two lids are bolted together to form the waveguide ports. The ports are built-in with waveguide to coaxial transitions so that the input and output ports have coaxial interface. The SP6T switch has been tested demonstrating excellent results.

What is claimed is:

1. A waveguide device for switching microwave signals comprising:

a) a waveguide housing comprising of a top element, a bottom element and a septum place in between the top and bottom elements, said top and bottom elements forming an enclosure having input ports and output ports, and said septum dividing said enclosure into an upper and lower channels;

b) said septum having a top surface and a bottom surface, said top and bottom surfaces of said septum having multiplicity of ridges, said ridges designed to smoothly guide microwave signals from said input ports to said output ports through said upper and lower channels;

c) said housing being made of a conductive material, preferably of metallic material; and d) multiplicity of short circuit means that can short circuit the top and the bottom elements to the ridges on the septum.

2. The waveguide of claim 1, wherein said input and out ports being rectangular.

3. The waveguide of claim 1, having two input and two output ports forming a 4 port waveguide device.

4. The waveguide of claim 1, having multiplicity of switching states, said states being determined by the location of said microwave short-circuit to realize various switching states.

5. The waveguide device as in claim 1 adapted for C- and R-type switches, said waveguide having two waveguides on the top of each other symmetric with respect to the septum and two waveguides placed side by side symmetric with respect to a plane set perpendicularly at the center and along the septum, said waveguide having four short-circuit means for the C-switch and six short-circuit means for the R-switch.

6. The waveguide device as in claim 1 adapted for T-type switches, having four rectangular input/output waveguides at the ends of a cross-shaped structure, placed symmetrically with respect to both the septum and the plane set perpendicularly at the center and along the septum, said device having ten short-circuit means.

7. The waveguide structure as in claim 1, wherein said microwave short-circuit means being a metallic screw, a linear motor, a MEMS actuator, a semiconductor switch or any one of mechanical actuators that can either be controlled manually or by an electric or magnetic signal.

8. The waveguide structure as in claim 1, further having an intermediate layer acting as a bifurcation for the input/output waveguide ports to route the signals either by the upper part of the circuit, between the intermediate layer and the upper plate, or by the lower part circuit, between the intermediate layer and bottom plate to realize a SP2T switch.

9. A waveguide switch as in claim 1, wherein the device being made of one piece using electroforming or any other fabrication technique.

10. A waveguide switch as in claim 1, wherein coaxial connectors being connected to the input/output ports to realize a waveguide switch with coaxial interface.

11. A waveguide switch as in claim 1, wherein multiplicity of switches being integrated to form a redundancy switch matrix or a signal routing switch matrix.

12. A metallic waveguide device for switching microwave signals comprising:

a) one input rectangular wave guide port and multiple output rectangular waveguide ports;

b) a common ridge waveguide junction allowing one input waveguide to transfer energy to multiplicity of ridge waveguides;

c) a housing comprising of a top metallic housing and a bottom metallic lid;

d) multiplicity of short circuit loads that short circuit the ridges in the top hosing to the bottom lid;

whereby said switch having several switching states, wherein said states being determined by the location of said microwave short-circuit to realize the various switching states.

13. The waveguide structure as in claim 12 adapted for an SP4T switch.

14. The waveguide structure as in claim 12 adapted for an SP6T switch.

15. The waveguide structure as in claim 12, wherein N output ports selected to realize SPNT switch when N can vary from to 2-8.

16. A waveguide switch as in claim 12, wherein said device is made of one piece rather than three pieces using electroforming or any other fabricate technique.

17. A waveguide switch as in claim 12, wherein coaxial connectors being connected to the input/output ports to realize a waveguide switch with coaxial interface.

18. A waveguide switch as in claim 12, wherein several switches being integrated to form a redundancy switch matrix or a signal routing switch matrix.

* * * * *